US005366646A

United States Patent [19]

Sato et al.

[11] Patent Number: 5,366,646

[45] Date of Patent: Nov. 22, 1994

[54] LUBRICATING OIL COMPOSITION

[75] Inventors: Takehisa Sato; Toshiaki Kuribayashi; Hironari Ueda, all of Ohi, Japan

[73] Assignee: Tonen Corporation, Tokyo, Japan

[21] Appl. No.: 52,688

[22] Filed: Apr. 27, 1993

[30] Foreign Application Priority Data

Apr. 28, 1992 [JP] Japan ..... 4-109903

[51] Int. Cl.[5] ..... C10M 129/66

[52] U.S. Cl. ..... 252/49.8; 252/50; 252/57; 252/78.5; 252/79

[58] Field of Search ..... 252/57, 49.8, 50, 79, 252/78.5

[56] References Cited

U.S. PATENT DOCUMENTS

| | | | |
|---|---|---|---|
| 3,472,775 | 10/1969 | Boehringer et al. | 252/57 |
| 3,723,320 | 3/1973 | Herber et al. | 252/57 |
| 3,859,318 | 1/1975 | Le Suer | 252/57 |
| 4,076,642 | 2/1978 | Herber et al. | 252/57 |

FOREIGN PATENT DOCUMENTS

| | | |
|---|---|---|
| 0377122A1 | 7/1990 | European Pat. Off. . |
| 0452816 | 10/1991 | European Pat. Off. . |
| 0460613 | 12/1991 | European Pat. Off. . |
| 0460614 | 12/1991 | European Pat. Off. . |
| 0470788 | 2/1992 | European Pat. Off. . |
| 0475751 | 3/1992 | European Pat. Off. . |
| 0499793 | 8/1992 | European Pat. Off. . |
| 57-63395 | 4/1982 | Japan . |

*Primary Examiner*—Jacqueline V. Howard

*Attorney, Agent, or Firm*—Armstrong, Westerman, Hattori, McLeland & Naughton

[57] ABSTRACT

The invention concerns a lubricating oil composition in which a lubricating oil base contains 0.1% by weight to 20% by weight of an aromatic glycidyl carboxylate having the following general formula (1):

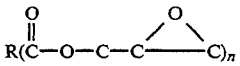

wherein R is a $C_{6-14}$ aryl or alkylaryl group, and n represents an integer of 1 or 2, and/or 0.05% by weight to 10% by weight of a phosphonate type additive having the following general formula (2):

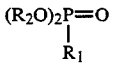

where $R_1$ or $R_2$ is selected from the group consisting of alkyl, aralkyl, aryl and hydroxyalkyl groups that may or may not have a substitute, and two $R_2$ groups may be identical with or different from each other, and which is excellent in stability to hydrolysis, heat and oxidation as well as in lubricating properties, and so provides a particularly excellent refrigerating oil composition.

5 Claims, No Drawings

LUBRICATING OIL COMPOSITION

BACKGROUND OF THE INVENTION

The present invention relates generally to a lubricating oil composition that is represented by refrigerating machine lubricating oil, viscous coupling lubricating oil, gear oil, mechanical booster pump oil, shock absorber oil, turbo-molecular pump bearing oil and belt tensioner oil and is excellent in stability to hydrolysis, heat and oxidation as well as in lubricating properties and, more particularly, to a refrigerating machine lubricating oil composition that is excellent in stability to hydrolysis, heat and oxidation as well as in lubricating properties, and is well compatible with a non-chlorine type of fluorine-containing refrigerant.

So far, chlorine-containing refrigerants such as R11 ($CCl_3F$), R12 ($CCl_2F_2$), R123 ($CF_3CHCl_2$) and R22 ($CHClF_2$) have been used as refrigerants for refrigerating machinery. In recent years in which the development of substitute flon is in urgent need in view of environmental problems, however, non-chlorine type flourine-containing refrigerants such as 1.1.1.2-tetrafluoroethane (R134a), difluoromethane (R32) and 1.1.2.2.2-pentafluoroethane (R125) have attracted wide attention. In has also been proposed to use as refrigerating machine oil polyalkylene glycol or ester oils that are compatible with these refrigerants (R134a, R32, R125, and so on). As the efficiency of refrigerating machinery increases, such refrigerating machine oil is now required to have an increased heat stability, and ester or polyalkylene glycol oils that is excellent in stability are used to this end. However, these ester or polyalkylene glycol oils are still less than satisfactory, because they hydrolyze in the presence of small amounts of water or air, or oxidize, resulting in an increase in the acid number. Their stability increase may be achieved by the incorporation of an epoxy compound in them, but the resulting oils become insufficient in terms of compatibility with refrigerants or stability, although varying depending on the structure of epoxy.

In the case of conventional chlorine-containing refrigerants, there is no need of taking any special care of their lubricating properties, because they possess some lubricating properties by themselves. However, non-chlorine type fluorine-containing refrigerants are required to be increased in lubricating properties for lack of lubricating properties. It has been known to incorporate a lubricant such as tricresyl phosphate in refrigerating machine lubricating oil, but this offers a problem that the resulting lubricating oil fails to produce its own lubricating properties sufficiently, when actually used with a non-chlorine type of fluorine-containing refrigerant.

A general object of the invention is to provide a lubricating oil composition that is more excellent in stability to hydrolysis, heat and oxidation as well as in lubricating properties, and a particular object of the invention is to provide a refrigerating machine lubricating oil composition used with a non-chlorine type of fluorine-containing refrigerant, which is more excellent in stability to hydrolysis and heat, esp., oxidation, as well as in lubricating properties, and which is more excellent in compatibility with the refrigerant.

SUMMARY OF THE INVENTION

The present invention provides a lubricating oil composition characterized in that a lubricating oil base contains 0.1% by weight to 20% by weight of an aromatic glycidyl carboxylate having the following general formula (1):

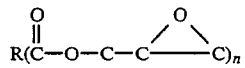

General Formula (1)

where R is an aryl or alkylaryl group having 6 to 14 carbon atoms, and n represents an integer of 1 or 2.

Thus, the present invention successfully provides a lubricating oil composition much more excellent in stability to hydrolysis, heat and oxidation than ever before.

The present invention also provides a lubricating oil composition characterized in that a lubricating oil base contains 0.05% by weight to 10% by weight of a phosphonate type additive having the following general formula (2):

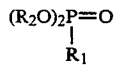

General Formula (2)

where $R_1$ or $R_2$ are selected from the group consisting of alkyl, aralkyl, aryl and hydroxyalkyl groups which may or may not have a substituent, and two $R_2$ groups may or may not be identical with each other.

The lubricating oil composition with the phosphonate type additive incorporated in it exhibits particularly excellent lubricating properties, when used in an oxygen-free atmosphere, as experienced in the case of a sliding part in refrigerating machinery. In this connection, it is noted that phosphite type lubricants so far used as lubricants, like tricresyl phosphite, hardly exhibit lubricating properties under such conditions. Although the detailed reason has yet to be clarified, it appears that there is a large difference in effect between when the lubricant is in the air and when it is in a refrigerant. This is because a fresh metal surface frictionally formed on the sliding part in the air is immediately covered with an oxide film, but a fresh metal surface frictionally formed on the sliding part in the refrigerant remains intact for an extended period of time, because the refrigerant forms an oxygen-free atmosphere. As a result of investigating the wear resistance of the sliding part when placed in an oxygen-free atmosphere, it has now been found that a lubricant oil containing a phosphonate type additive can exhibit excellent lubricating properties in an oxygen-free atmosphere.

Further, the present invention provides a lubricating oil composition characterized in that a lubricating oil base contains 0.1% by weight to 20% by weight of an aromatic glydicyl carboxylate having General Formula (1) and 0.05% by weight to 10% by weight of a phosphonate type additive having General Formula (2).

This lubricating oil composition, because of excelling in the reactivity with an acid or water, is improved in terms of stability to hydrolysis, heat and oxidation as well as in lubricating properties.

Still further, the present invention provides a lubricating oil composition characterized in that a lubricating oil base contains 0.1% by weight to 20% by weight of an aromatic glycidyl carboxylate having General Formula (1), 0.05% by weight to 10% by weight of a phosphonate type additive having General Formula (2), and 0.01% by weight to 5% by weight of a benzotriazole derivative having the following general formula (3):

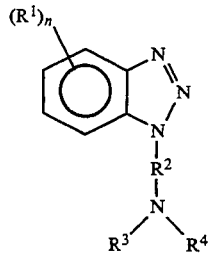

General Formula (3)

where $R^1$ is an alkyl or aryl group having 1 to 6 carbon atoms, $R^2$ is an alkylene or arylene group having 1 to 6 carbon atoms, $R^3$ or $R^4$ is an alkyl, aryl or alkylaryl group having 1 to 12 carbon atoms, or $R^3$ and $R^4$ may form together a heterocylcle, and n is an integer of 0 or 1.

This lubricating oil composition can prevent any side reaction of the aromatic glycidyl carboxylate with the phosphorous type additive, and so is much more improved in terms of stability to hydrolysis, heat and oxidation as well as in lubricating properties.

Still further, the present invention provides a lubricating oil composition characterized in that a polyether oil having a viscosity lying in the range of 10 $mm^2/s$ to 500 $mm^2/g$ at 40° C. and a hydroxyl number of up to 10 mg KOH/g contains 0.1% by weight to 20% by weight of a compound having an epoxycycloalkyl group in its molecule.

This lubricating oil composition is much more excellent in stability to hydrolysis, heat and oxidation as well as in lubricating properties.

Still further, each of the lubricating oil compositions of the invention mentioned above is characterized in that the lubricating oil base is an ester or polyether oil having a viscosity lying in the range of 10 $mm^2/s$ to 500 $mm^2/s$ at 40° C., and in that it is a refrigerating machine oil composition.

The refrigerating machine oil composition according to the invention is much more improved in terms of stability to hydrolysis, heat and oxidation as well as in lubricating properties, and is much more excellent in compatibility with a fluorine type of aliphatic hydrocarbon refrigerant that does not contain any chlorine atom.

Reference will now be made to the lubricating oil base in the lubricating oil compositions of the invention.

For the lubricating oil base, use may be made of synthetic and/or mineral oils.

The usable synthetic oils, for instance, may include polyol esters (ester oils), polyether oils, polyolefins, dialkylbezenes, alkyl diphenyl ethers, and silicone oils.

The ester oils may include the following classes of esters. Among them, preference is given to polyol ester, fumaric acid ester polymers, and ester oils comprising combinations of these.

(1) Polyesters of aliphatic polyhydric alcohols with linear or branched fatty acids deserve the first mention.

Among the aliphatic polyhydric alcohols forming these polyesters, there are trimethylolpropane, ditrimethylolpropane, trimethylolethane, ditrimethylolethane, pentaerythritol, dipentaerythritol, and tripentaerythritol. Among the fatty acids, mention is made of those having 3 to 12 carbon atoms, preferably, propionic acid, butyric acid, valeric acid, hexoic acid, octanoic acid, nonanoic acid, decanoic acid, dodecanoic acid, isovaleric acid, neopentanoic acid, 2-methylbutyric acid, 2-ethylbutyric acid, 2-methylhexoic acid, 2-ethylhexoic acid, isooctanoic acid, isononanoic acid, isodecanoic acid, 2,2'-dimethyloctanoic acid, 2-butyloctanoic acid, and 3,5,5-trimethylhexoic acid.

Partial esters of aliphatic polyhydric alcohols with linear or branched fatty acids may also be used.

The aliphatic polyhydric alcohols, for instance, may be trimethylolpropane, ditrimethylolpropane, trimethylolethane, ditrimethylolethane, pentaerythritol, dipentaerythritol, and tripentaerythritol. Among the fatty acids, mention is made of those having 3 to 9 carbon atoms, preferably, propionic acid, butyric acid, valeric acid, hexoic acid, heptanoic acid, octanoic acid, nonanoic acid, 2-methylhexoic acid, 2-ethylhexoic acid, isooctanoic acid, isononanoic acid, isodecanoic acid, 2,2'-dimethyloctanoic acid, 2-butyloctanoic acid, and 3,5,5-trimethylhexoic acid.

Most preferably, the esters of the aliphatic polyhydric alcohols with linear or branched fatty acids are those of pentaerythritol, dipentaerythritol, and tripentaerythritol with fatty acids having 5 to 12, preferably 5 to 7 carbon atoms, for instance, valeric acid, hexoic acid, heptanoic acid, 2-methylhexoic acid, 2-ethylhexoic acid, isooctanoic acid, isononaoic acid, isodecanoic acid, 2,2'-dimethyloctanoic acid, 2-butyloctanoic acid, or their mixtures.

These partial esters may be obtained by the reaction of a suitably regulated number of moles of the aliphatic polyhydric alcohol with a suitably regulated number of moles of the fatty acid.

(2) Use may also be made of diesters of an aliphatic polyhydric alcohol represented by neopentyl glycol with a linear or branched fatty acid having 6 to 9 carbon atoms, for instance, hexoic acid, heptanoic acid, octanoic acid, nonanoic acid, 2-ethylbutyric acid, 2-methylhexoic acid, 2-ethylhexoic acid, isooctanoic acid, isonoanoic acid, or 3,5,5-trimethylhexoic acid.

(3) Complex esters of partial esters of aliphatic polyhydric alcohols with linear or branched fatty acids having 3 to 9 carbon atoms and linear or branched aliphatic dibasic acids or aromatic dibasic acids may be used as well.

For such aliphatic polyhydric alochols, use may be made of trimethylolpropane, trimethylolethane, pentaerythritol, dipentaerythritol, and so on.

For the fatty acids having 3 to 12 carbon atoms, use may be made of propionic acid, butyric acid, isobutyric acid, valeric acid, hexoic acid, heptanoic acid, octanoic acid, nonanoic acid, decanoic acid, dodecanoic acid, 2-methylhexoic acid, 2-ethylhexoic acid, isooctanoic acid, isononanoic acid, isodecanoic acid, 2,2'-dimethyloctanoic acid, 2-butyloctanoic acid, 3,5,5-trimethylhexoic acid, and so on.

For these complex esters, it is desired to use fatty acids having 5 to 7, preferably 5 to 6 carbon atoms.

For such fatty acids, use may be made of valeric acid, hexoic acid, isovaleric acid, 2-methylbutyric acid, 2-ethylbutric acid, or their mixture. In this regard, it is preferable that the fatty acids consisting of five carbon atoms and six carbon atoms are mixed together at a weight ratio of 10:90 to 90:10 for use.

For the aliphatic dibasic acids used with such fatty acids for estrification with polyhydric alcohols, use may be made of succinic acid, adipic acid, pimelic acid, suberic acid, azelaic acid, sebacic acid, undecanoic diacid, dodecanoic diacid, tridecanoic diacid, carboxyoctadecanoic acid, carboxymethyloctadecanoic acid, docosanoic diacid, and so on. Phthalic acid, isophthalic acid, and so on may be used for the aromatic dibasic acids; trimellitic acid, etc., for the aromatic tribasic acids; and pyromellitic acid, etc., for the aromatic tetrabasic acids.

For the esterification reaction, the polyhydric alcohol and the aliphatic or aromatic dibasic acid may first be allowed to react with each other at a given ratio for partial esterification. Then, the resulting partial ester may be allowed to react with the fatty acid. Alternatively, the dibasic and fatty acids may be reversed in order, or mixtures of such acids may be used for estrification.

(4) Dialkyl esters (having 16 to 22 carbon atoms) of linear or branched aliphatic dibasic acids may be used as well.

For the aliphatic dibasic acids, use may be made of succinic acid, glutaric acid, adipic acid, pimelic acid, suberic acid, azelaic acid, sebacic acid, undecanoic diacid, dodecanoic diacid, tridecanoic diacid, carboxyoctadecanoic acid, carboxymethyloctadecanoic acid, docosanoic diacid, and acids that are similar in property to these. Preferable aliphatic dibasic acids are succinic acid, adipic acid, sebacic acid, undecanoic diacid, dodecanoic diacide, carboxyoctadecanoic acid, and carboxymethyloctadecanoic acid.

The alcohol component used has 5 to 8 carbon atoms, and may be amyl alcohol, hexyl alcohol, heptyl alcohol, octyl alcohol, and their isomers. Among others, isoamyl alcohol, isohexyl alcohol and octyl alcohol are preferable.

Examples of the dialkyl ester are dioctyl adipate, di-isoheptyl adipate, dihexyl sebacate, and diheptyl succinate.

(5) Dialkyl esters (having 18 to 26 carbon atoms) of aromatic dibasic acids may be used as well.

For the aromatic dibasic acids, mention is made of phthalic acid, isophthalic acid, and thier equivalents. For the alcohol components in the dialkyl esters, use may be made of alcohols having 5 to 8 carbon atoms, for instance, amyl alcohol, hexyl alcohol, heptyl alcohol, octyl alcohol, and their isomers. Preferable alcohols are isoamyl alcohol, isoheptyl alochol, and octyl alcohol. The aromatic dieters may include dioctyl phthalate, di-isohepty phthalate, di-isoamyl phthalate, and so on.

(6) For the alcohol component, use is made of adducts of a monohydric alcohol selected from methanol, ethanol, propanol, butanol or like alcohol and their isomers, or a trihydric alochol such as glycerin and trimethylolpropane with 1 mole to 10 moles, preferably 1 to 6 moles of an alkylene oxide selected from ethylene oxide, propylene oxide, butylene oxide, amylene oxide or like oxide, and their isomers.

Organic carboxylates include diesters obtained by the esterification of adducts of monohydric alcohols with alkylene oxides with aliphatic dibasic acids such as adipic acid, pimelic acid, suberic acid, azelaic acid, sebacic acid, undecanoic diacid, dodecanoic diacid, carboxyoctadecanoic acid, carboxymethyloctadecanoic acid and docosanic diacid, or with aromatic dibasic acids such as phthalic acid.

Use may be made of esters obtained by the esterification of adducts of polyhydric alcohols such as glycerin and trimethylolpropane with 1 to 10 moles of alkylene oxides with the use of, e.g., propionic acid, valeric acid, hexoic acid, heptanoic acid, octanoic acid, nonaoic acid, decanoic acid, dodecanoic acid, 2-methylhexoic, 2-ethylhexoic, isooctanoic acid, isononaoic acid, isodecanoic acid, 2,2'-dimethyloctanoic acid, and 2-butyloctanoic acid.

For the fatty acids constituting the organic carboxylates, use may be made of linear or branched fatty acids. However, preference is given to using branched fatty acids, because they make a greater contribution to stability to hydrolysis.

The organic carboxylates mentioned above may be used alone. However, it is preferable to use them in combination of two or more for viscosity regulation depending on the purposes.

In the case of a complex type of organic carboxylate (3) having a high viscosity, for instance, its viscosity regulation depending on the purposes may be achieved by using an ester oil of an aliphatic polyhydric alcohol with a fatty acid having 3 to 9 carbon atoms, which has a viscosity of up to 120 $mm^2/s$ at 40° C. In the case of an organic carboxylate having a low viscosity, on the other hand, it is preferable to add a polymer to it for its viscosity regulation. The polymer used has preferably a viscosity of 500 $mm^2/s$ or higher, as measured at 40° C.

For such polymers, use may be made of polyalkyl methacrylates (with the alkyl group having 4 to 8 carbon atoms), polyalkylene glycols (e.g., copolymers consisting of polypropylene or polyethylene glycol components and polypropylene glycol components, or polypropylene glycol components and polytetramethylene glycol components), polyesters consisting of neopentyl glycol and an aliphatic dibasic acid and having the following formula:

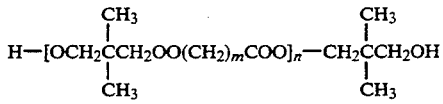

where m is an integer of 1 to 20 and n is an integer of 1 to 10, and so on.

The amount of the polymer added, although not critical if an ester oil having a desired viscosity is obtainable, lies usually in the range of 1% by weight to 99% by weight.

Other esters such as fumarate polymers may be used as well.

The fumarate polymers are fumarate homopolymers or copolymers of fumarates with unsaturated aliphatic hydrocarbons, and has the following general formula:

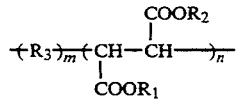

where $R_1$ and $R_2$ may be identical with or different from each other, and each stands for a linear or branched alkyl or allyl group having 1 to 9 carbon atoms, or a polyalkylene oxide group that may or may not be substituted at the terminals, $R_3$ represents an alkylene group, an unsubstituted alkylene group, or an alkylene oxide group, provided that $R_3$ accounts for 50 mole % or less of the whole, m is an integer greater than 0, and n is an integer of 1 or more, preferably 1 to 12. In this connection, it is noted that both terminals of the copolymer represented by the above formula are residues used for polymerization reaction, and are not shown for simplicity.

More illustratively, mention is made of ester oligomers of diethyl fumarate, dibutyl fumarate, and so on.

In the case of a refrigerating machine oil composition, an ester oil having a viscosity lying in the range of 10 $mm^2/s$ to 500 $mm^2/s$ at 40° C. is used. This ester oil may be used alone, or in admixture with a mineral oil or other synthetic refrigerating machine oil. It is preferable that the ester oil accounts for 10% by weight to 100% by weight of the mixed oil. It is here noted that the mixed oil, when containing less than 10% by weight of the ester oil, becomes unsatisfactory in terms of compatibility with refrigerants, especially at elevated temperatures.

Referring then to the polyether oil, it is a split polymer or copolymer of a mono - to hexa-hydric alcohol with a linear or branched alkylene oxide with the alkylene moiety having 2 to 5, preferably 2 or 3 carbon atoms. Here, the "alkylene oxide" refers to ethylene oxide, propylene oxide, butylene oxide, or their mixture, all having a viscosity lying in the range of 10 $mm^2/s$ to 500 $mm^2/s$ at 40° C. Preferably, the alkylene oxide is a compound to which a given amount of the alkylene oxide, e.g., propylene oxide is added and which is substituted at its terminal hydroxyl group.

Examples of the polyether oil are polyoxypropylene glycol, polyoxyethylene glycol, polyoxy-1,2-butylene glycol, polyoxy-2,3-butylene glycol, polyoxyethylene polyoxypropylene glycol, and polyoxyethylene polyoxytetramethylene glycol, the terminal hydroxyl groups of which are substituted by groups, e.g., methyl, ethyl, n- or iso-propyl, n-, iso- or t-butyl, and so on. The polyether oil has a hydroxyl number of preferably 20 mg KOH/g or less, more preferably 10 mg KOH/g or less, and most preferably 6 mg KOH/g or less.

The hydroxyl number of the polyether oil has some correlation with the addition of an epoxy compound having the general formula (1) to be referred to later, and should preferably be lower than a certain value. This is partly because a high hydroxyl number hinders the action of the epoxy compound added and partly because the polyether oil, when formulated into a refrigerating machine oil composition, offers a problem that precipitates are formed due to unsatisfactory compatibility with a refrigerant.

Preferable examples of the polyether oil are polypropylene glycol dimethyl ether, polypropylene glycol diethyl ether, polypropylene glycol dipropyl ether and polypropylene glycol dibutyl ether, all having a molecular weight of 700 to 1,300.

In the case of a refrigerating machine oil composition, the polyether oil having a viscosity lying in the range of 10 $mm^2/s$ to 500 $mm^2/s$ at 40° C. is used. This polyether oil may be used alone, or in admixture with mineral oil or other synthetic oil. It is preferable that the polyether oil accounts for 10% by weight to 100% by weight of the mixed oil. In this regard, it is noted that the mixed oil, when containing the polyether oil at a low ratio, becomes unsatisfactory in terms of compatibility with a refrigerant.

The polyolefins are homopolymer of any one member selected from olefinic hydrocarbons which have 2 to 14, preferably 4 to 12 carbon atoms and may or may not contain a branched chain, or copolymers of two or more members selected from those hydrocarbons, and have a mean molecular weight lying in the range of 100 to about 2,000, preferably 200 to about 1,000. In particular, it is preferable that these polyolefins have been cleared of unsaturated bonds by hydrogenation.

Preferable examples of the polyolefin are polybutene, α-olefin oligomer and ethylene-α-olefin oligomer. For instance, the polybutene is preferably obtained by the copolymerization of a main component, isobutene, and a minor component, a mixture of butene-1 with butene-2. The α-olefin oligomer may be obtained by the copolymerization of α-olefin mixtures having 6 to 12 carbon atoms, which are obtained by the thermal cracking of hydrocarbons or the tri- to hexa-merization of lower olefins, for instance, 25% by weight to 50% by weight of hexene-1, 30% by weight to 40% by weight of octene-1 and 25% by weight to 40% by weight of decene-1. Further, oligomers obtainable from sole monomers like decene are suitably used in the invention. Moreover, the ethylene-α-olefin oligomer used may be obtained by the polymerization of monomeric mixtures of 40% by weight to 90% by weight of ethylene and 10% by weight to 60% by weight of an α-olefin like propylene.

These polyolefins may be produced with the use of Friedel-Crafts or Ziegler catalysts, like aluminum chloride and boron fluoride, and an oxide catalyst, like chromium oxide. The polyolefins may be hydrogenated by clearing the reaction product of the catalyst and, then, bringing it into contact with a hydrogenation catalyst like nickel-molybdenum/alumina with the application of heat and pressure.

The alkylbenzene is an alkylbenzene type oil that mainly contains dialkylated aromatic hydrocarbons obtained as by-products in making detergent materials by the alkylation of aromatic hydrocarbons, like benzene or toluene, by Friedel-Crafts reaction. The alkyl group may be linear and/or branched in chain form.

For the silicone oil, use may be made of an organopolysiloxane represented by the following formula:

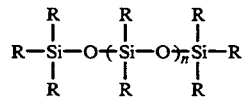

where R's stand for identical or different, optionally halogenated hydrocarbon groups having 1 to 18 carbon atoms, and n represents an integer of 1 to 3,000.

The groups represented by R are alkyl groups such as methyl, ethyl, n-propyl, i-propyl, n-butyl, i-butyl, t-butyl, n-pentyl, neopentyl, hexyl, heptyl, octyl, decyl or octadecyl; aryl groups such as phenyl and naphthyl; aralkyl groups such as benzyl, 1-phenylethyl and 2-phenylethyl; araryl groups such as o-, m-, and p-diphenyls; and halogenated hydrocarbon groups such as o-, m-, and p-chlorophenyls, o-, m-, and p-bromophenyls, 3,3,3-trifluoropropyl, 1,1,1,3,3,3-hexafluoro-2-propyl, heptafluoroisopropyl and heptafluoro-n-propyl. In particular, $C_{1-8}$ fluorinated hydrocarbon groups other than aliphatic unsaturated groups are advantageously used as the groups R, and methyl and phenyl groups are advantageous as well. Moreover, mixtures of methylpolysiloxane and phenylpolysiloxane may be used.

For the mineral oil base, use is made of 60 neutral oil, 100 neutral oil, 150 neutral oil, 300 neutral oil and 500 neutral oil, all obtained by solvent or hydrogenolysis refining, and oil bases having low flow-points, which are obtained by removing wax matter from the above base oils so as to improve their fluidity at low temperatures. These oil bases may be used alone, or may be mixed together at suitable ratios for use.

The lubricating oil bases have a viscosity lying in the range of 10 $mm^2/s$ to 500,000 $mm^2/s$ at 40° C., and may be used alone or in admixture.

In the case of a refrigerating machine lubricating oil in particular, the oil base composed mainly of an ester oil or polyalkylene glycol having a viscosity lying in the range of 10 $mm^2/s$ to 500 $mm^2/s$ at 40° C. is preferably used as the synthetic oil. In this case, the ester oil and polyalkylene glycol may be used alone, or in combination with mineral oil or other synthetic lubricating oil. In this regard, it is preferable that the ester oil or polyalkylene glycol accounts for 10% by weight to 100% by weight of the mixed oil. Notice that the mixed oil containing lower proportions of the ester oil or polyalkylene glycol becomes unsatisfactory in terms of compatibility with a refrigerant, esp., at elevated temperatures, when used as refrigerating machine oil.

In the following description, the additive or additives used with the lubricating oil compositions of the invention will be explained at great length.

Aromatic Glycidyl Carboxylate Represented by General Formula (1)

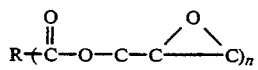

where R is a $C_{6-14}$ aryl or alkylaryl group, and n stands for an integer of 1 or 2, preferably 1.

This aromatic glycidyl carboxylate is added to the lubricating oil composition so as to impart stability to hydrolysis thereto. When R is an aryl group, it may be phenyl, naphthyl, and so on. When R is an alkylaryl, it may be alkylated phenyl, naphthyl, and so on.

More illustratively and more preferably, glycidyl benzoate, glycidyl terephthalate, glycidyl orthophthalate and alkylated glycidyl benzoate are used.

These aromatic glycidyl carboxylates are much higher in reactivity with water than aliphatic glycidyl carboxylates or glycidyl ethers, for instance, and are excellent in compatibility with a non-chlorine type of fluorine-containing refrigerants, when formulated into a refrigerating machine oil composition. Preferably, the content of chlorine in these aromatic glycidyl carboxylates is 0.5% by weight or below. A chlorine content exceeding 0.5% by weight often results in precipitation.

The aromatic glycidyl carboxylate may be added to the lubricating oil base in an amount of preferably 0.1% by weight to 20% by weight, more preferably 0.5% by weight to 5% by weight. At higher than 20% by weight, the glycidyl carboxylate offers some problems such as a lowering of the flash point of the resulting composition, a lowering of the compatibility of the composition with refrigerants, degradation of the stability of the composition itself, and so on.

When a polyether oil having a viscosity lying in the range of 10 $mm^2/s$ to 500 $mm^2/s$ at 40° C. and a hydroxyl number of up to 10 mg KOH/g is used as the oil base of the lubricating oil composition of the invention, it has now been found that 0.1% by weight to 20% by weight, preferably 0.5% by weight to 5% by weight of an epoxy compound, i.e., a compound having an epoxycycloalkyl group in its molecule can be used in place of the aromatic glycidyl carboxylate represented by General Formula (1), thereby obtaining a more excellent lubricating oil composition. At higher than 20% by weight, however, the epoxy compound poses some problems such as a lowering of the flash point of the composition, a lowering of the compatibility of the composition with refrigerants, degradation of the stability of the composition itself, and so on.

When used as the oil base, a polyether oil with the hydroxyl number exceeding 10 mg KOH/g reacts with the epoxy compound in a low-temperature region, resulting in the precipitation of polymeric matter, although the detailed reason has yet to be elucidated. In the case of a refrigerating machine oil composition in particular, its compatibility with a non-chlorine type of fluorine-containing refrigerant gets worse. Another problem with this is that precipitates are deposited on, e.g., the electrically heated surface of a refrigerating machine condenser, making the efficiency of heat transmission worse.

Examples of the epoxy compound having an epoxycycloalkyl group in its molecule are 3,4-epoxycyclohexylmethyl-3,4-epoxycyclohexane carboxylate, vinylcyclohexene dioxide, 2-(3,4 -epoxycyclohexyl-5,5-spiro-3,4-epoxy)cyclohexane-metadioxane, bis(3,4-epoxycyclohexylmethyl)adipate, cyclohexene oxide, cyclopentadiene monoxide, 4-vinylcyclohexene-1,2-oxide, bis (methylcyclohexenyl)dioxide, dicyclopentadiene diepoxide, bis(2,3-epoxycyclopentyl)ether, bis(3,4-epoxycyclohexylmethyl) oxalate and 4,10-dioxatetracyclo[5,4,0,$0^{5,6}$,$0^{9,11}$]undecane. The chlorine content of the epoxy compound having an epoxycycloalkyl group in its molecule is preferably up to 0.5% by weight. The use of an epoxy compound having a chlorine content higher than 0.5% by weight poses some problems, for instance, chlorine precipitation.

Now, explanation will be given to the phosphonate type additive having General Formula (2):

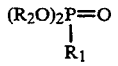

where $R_1$ or each $R_2$ is selected from alkyl, aralkyl, aryl or hydroxyalkyl groups which may or may not have a substituent, and two $R_2$'s may be identical with or different from each other.

The groups $R_1$ or $R_2$ may have hydroxyl, acyl, alkoxylcarbonyl, glycidyloxycarbonyl or other groups as substituents, and preferable examples of the substituents are hydroxyl, acyl, alkoxycarbonyl and glycidyloxycarbonyl groups.

Specific but not exclusive examples of such a phosphonate type additive are dioctyl methylphosphonate, dioctyl hydroxymethylphosphonate, ethyl 3-phosphonopropionate, glycidyl o,o-dibutylphosphono-2-methylpropionate, dioctyl phenylphosphonate, diethyl phenylphosphonate and diethyl 3,5 -di-t-butyl-4-hydroxybenzylphosphonate.

When the lubricating oil composition is formulated into a refrigerating machine oil composition, it is preferable that each $R_2$ in General Formula (2) is an alkyl group having 12 or less carbon atoms. Such a phosphonate type additive is well compatible with a refrigerant such as R134a, and lends itself particularly fit for being added to refrigerating machine oil. These phosphorous type additives may be used alone or in admixture.

While phosphorous type additives represented by $(RO)_3P{=}O$ and $(RO)_3P$ where R has the same meanings as defined in connection with $R_2$ in General Formula (2) may be used in place of the phosphonate type additive having General Formula (2), it is understood that it is preferable to use the additives having General Formula (2).

The phosphonate type additive having General Formula (2) may be used either alone or in admixture with the phosphorous additives mentioned above, and is used at a proportion of 0.05% by weight to 10% by weight relative to the lubricating oil base. At higher than 5% by weight, this additive poses a metal corrosion problem.

The phosphonate type additive having General Formula (2) can well produce its own effect, when used in an oxygen-free atmosphere. In the present disclosure, the term "oxygen-free atmosphere" is understood to be applied generally to lubricating oil used in a closed system and, more specifically, to refrigerating machine oil used in a refrigerant, or to lubricating oil used in a nitrogenous atmosphere or in vacuo. This type of lubricating oil is used under conditions that are usually defined by partial oxygen pressure having an initial value of up to $10^{-1}$ torr, preferably up to $10^{-2}$ torr.

A lubricating oil composition having much more improved stability is obtainable by the addition of a nitrogenous compound having General Formula (3):

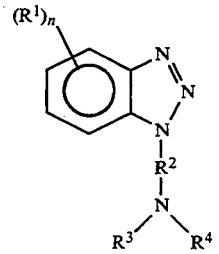

where $R^1$ is an alkyl or aryl group having 1 to 6 carbon atoms, $R^2$ is an alkylene or arylene group having 1 to 6 carbon atoms, and $R^3$ and $R^4$ are each an alkyl, aryl or alkylaryl having 1 to 12 and may form together a heterocycle, and n stands for an integer of 0 or 1.

More specifically but not exclusively, $R^1$ and $R^2$ may be methyl, ethyl, and pheny. Similarly, $R^2$ may be methylene, ethylene, and phenylene. $R^3$ and $R^4$ may independently be methyl, ethyl, propyl, butyl, pentyl, hexyl, octyl, and phenyl, and may form together a heterocyle such as a pyrrolidine or piperidine ring. More specifically but not exclusively, paritcular preferene is given to 1-dioctylaminomethyl-4-methylbenzotriazole and 1-dioctylaminomethyl-5-methylbenzotriazole.

The nitrogenous compound having General Formula (3) is added to the lubricating oil base in an amount of 0.01% by weight to 5% by weight. At higher than 5% by weight, the nitrogenous compound offers discoloration or other problems.

Explanation will then be given to how the additives act in the lubricating oil composition of the invention. The lubricating oil composition is improved in terms of stability to hydrolysis by containing the aromatic glycidyl carboxylate having General Formula (1). Especially when the lubricating oil composition is used in the form of a refrigerating machine oil composition, it can exhibit excellent compatibility with a refrigerant. When the lubricating oil composition is used in the form of a refrigerating machine oil composition, it contains the phosphorous additive having General Formula (2) so as to reduce its action on wearing metals forming refrigerating machinery, e.g., aluminum and iron materials. In some cases, however, the aromatic glycidyl carboxylate reacts with the phosphorous additive to form by-products, which then settle down, resulting in pipe clogging occuring in refrigerating machinery. To ward off such undesired side reactions, the nitrogenous compound having General Formula (3) is added. The nitrogenous compound having General Formula (3), at the same time, acts to deactivate metals forming refrigerating machinery, e.g., inhibit copper from discoloring, thus providing a more stable refrigerating machine oil composition.

The lubricating oil composition of the invention may additionally contain antioxidants, for instance, represented by amine type antioxidantss such as di(alkylphenyl)amine (with the alkyl group having 4 to 20 carbon atoms), phenyl-α-naphthylamine, alkyldiphenylamine (with the alkyl group having 4 to 20 carbon atoms), N-nitroso-diphenylamine, phenothiazine, N,N'-dinaphthyl-p-phenylenediamine, acridine, N-methylphenothiazine, N-ethylphenothiazine, dipyridylamine, diphenylamine, phenolamine and 2,6-di-t-butyl-α-dimethylamino p-cresol; phenolic antioxidantss such as 2,6-di-t-butyl p-cresol, 4,4'-methylenebis(2,6-di-t-butylphenol), 2,6-di-t-butyl-4-N,N-dimethylaminomethylphenol and 2,6-di-t-butylphenol; organic metal compound type antioxidants such as organic iron salt, e.g., iron octoate, ferrocene and iron naphthoate, organic cerium salts, e.g., cerium naphthoate and cerium toluate, and organic zirconium slats, e.g., zirconium octoate; and phosphites such as tri-di-t-butylphenyl phosphite and trioctyl phosphite. These antioxidants may be used alone or in combination of two or more.

The antioxidant(s) mentioned above may be used in an amount of 0.001% by weight to 5% by weight, preferably 0.01 to 2% by weight relative to the oil base.

Moreover, the lubricating oil composition of the invention may contain some other additives such as detergent-dispersants, corrosion inhibitors, anti-defoaming agents, metal deactivators and rust preventives depending on for what purpose it is used.

For instance, when used as refrigerating oil, the lubricating oil composition of the invention may contain corrosion inhibitors, wear preventives, anti-foaming agents, metal deactivators and rust preventives, and when used as gear oil, it may contain wear preventives, viscosity index improvers, metal deactivators and corrosion inhibitors.

The detergent-dispersant used includes imide succinate, alkylbenzene sulfonate, and so on.

The corrosion inhibitor used includes isostearate, n-octadecyl ammonium stearate, Duomin T.deoleate, lead naphthenate, sorbitan oleate, pentaerythritol.oleate, oleylsarcosine, alkyl succinate, alkeyl succinate, and these derivatives. These inhibitors may be used in an amount of 0.001% by weight to 1.0% by weight, preferably 0.01% by weight to 0.5% by weight relative to the oil base. The anti-foaming agent may be silicone, and may be used in an amount of 0.0001% by weight to 0.003% by weight, preferably 0.0001% by weight to 0.001% by weight relative to the oil base.

The metal activators used, for instance, may be thiadiazoles, thiadiazole derivatives, triazoles, triazole derivatives and dithiocarbamates, and may be used in an amount of 0.01% by weight to 10% by weight, preferably 0.01% by weight to 1.0% by weight relative to the oil base.

The corrosion inhibitors used, for instance, may be succinic acid, succinates, oleic acid tallow amide, barium sulfonate and calcium sulfonate, and may be used in an amount of 0.01% by weight to 10% by weight, preferably 0.01% by weight to 1.0% by weight relative to the oil base.

In the following description, the viscosity range of the lubricating oil composition according to the invention will be explained at great length. As already mentioned, the lubricating oil composition of the invention has a viscosity lying in the range of 10 to 500,000 $mm^2/s$ at 40° C.

When used in the form of a refrigerating machine oil composition, the lubricating oil composition of the invention has a viscosity lying in the range of 10 to 500 $mm^2/s$, preferably 20 to 480 $mm^2/s$ at 40° C., whereas when used for a refrigerator, it has a viscosity lying in the range of 10 $mm^2/s$ to 40 $mm^2/s$, preferably 15 $mm^2/s$ to 35 $mm^2/s$ at 40° C. In order for the lubricating oil composition of the invention to be used in the form of refrigerating machine oil for a refrigerating machine of a car air conditioner, it has preferably a viscosity in the range of 40 $mm^2/s$ to 500 $mm^2/s$. When used for a reciprocation type compressor of a car air conditioner, it has preferably a viscosity in the range of 40 $mm^2/s$ to 120 $mm^2/s$, desirously 80 $mm^2/s$ to 100 $mm^2/s$, and when used for a rotary type compressor, it has preferably a viscosity in the range of 80 $mm^2/s$ to 500 $mm^2/s$, desirously 100 $mm^2/s$ to 450 $mm^2/s$. At less than 10 $mm^2/s$, the lubricating oil composition of the invention is well compatible with refrigerants at elevated temperatures, but poses some problems in connection with lubricating properties, sealing properties and heat stability due to its low viscosity. A lubricating oil composition having a viscosity exceeding 500 $mm^2/s$ is not preferable, because its compatibility with refrigerants becomes low. Even within the range of 10 to 500 $mm^2/s$, the viscosity of the lubricating oil composition of the invention varies depending on what types of machinery are used with it. For instance, the lubricating oil composition for refrigerators gives rise to large friction loss at sliding portions, when its viscosity exceeds 40 $mm^2/s$. Further, the lubricating oil composition for a reciprocation type of car air conditioner offers a problem in connection with lubricating properties, when its viscosity becomes less than 40 $mm^2/s$, whereas it gives rise to large friction loss at sliding portions, when its viscosity exceeds 120 $mm^2/s$. Still further, the lubricating oil composition for a rotary type of air conditioner poses a problem in connection with sealing properties, when its viscosity becomes below 80 $mm^2/s$, whereas it offers a problem in connection with compatibility with refrigerants, when its viscosity exceeds 500 $mm^2/s$ When used in the form of gear oil, the lubricating oil composition of the invention should preferably be regulated to the viscosity range of 20 $mm^2/s$ to 460 $mm^2/s$ at 40° C., and when used for viscous coupling, it should preferably be regulated to the viscosity range of 20 $mm^2/s$ to 500,000 $mm^2/s$ at 40° C.

While the present invention will now be explained with reference to some examples, it is understood that the "stability to hydrolysis", "stability to oxidation", "lubricating properties" and "compatibility" referred to therein were measured by the following procedures.

Stability to Hydrolysis

Sample or control oil (250 ml), one copper wire, one aluminum wire, one iron wire, (all serving as catalysts and of 8 mm in inner diameter and 30 mm in length), water (1,000 ppm) and a refrigerant flon 134a (40 g) were placed in an iron vessel having an inner volume of 350 ml, which was heated at 175° C. for 20 days, and from which the oil was then removed to determine the total acid number, in mg KOH/g, by the JIS K 2501 neutralization number testing procedure.

Stability to Oxidation

Sample or control oil (250 ml), one copper wire, one aluminum wire, one iron wire, (all serving as catalysts and of 8 mm in inner diameter and 30 mm in length), water (1,000 ppm), a refrigerant flon 134a (40 g) and air (100 ml) were placed in an iron vessel having an inner volume of 350 ml, which was heated at 175° C. for 20 days, and from which the oil was then removed to determine the total acid number, in mg KOH/g, by the JIS K 2501 neutralization number testing procedure. Apart from this, suspended solids in the oil were visually observed to determine whether or not there was precipitation.

Lubricating Properties of Oil or Abrasion Loss of Test Pieces

Aluminum and cast iron sheets were used with a ball-on-disk type of abrasion testing machine under the following condition, thereby determining the abrasion widths in mm.

Abrasion Testing Conditions

Load: 12.7 N
Friction Speed: 3 mm/s
Disk: A390
Balls: ¼-inch bearing balls of SUS440C
Atmosphere: in the air or R134a under 700 mmHg
Temperature: room temperature (25° C.)

Compatibility Testing Procedure

Sample or control oil (11.7% by weight) and a refrigerant (1.1.1.2-tetrafluoroethane) were mixed together at a total amount of 2 ml in a glass tube. The glass tube is placed in a constant temperature bath having a heater and a cooler to measure the temperature at which the sample oil separates from the refrigerant.

Sealed Tube Testing

Sample oil (1 g), 1.1.1.2-tetrafluoroethane (1 g) and each of iron, copper and aluminum test metal pieces (of 1.7 mm in diameter and 40 mm in length) were heat-sealed in a glass tube. After this, the glass tube was heated at the temperature of 175° C. for 14 days (366 hours). After the completion of the testing, the degree of discoloration of the test oil was measured, and the state of the metal piece was observed.

EXAMPLE 1

Antioxidants di(octylphenyl)amine (0.20% by weight) and 2,6-di-t-butyl-4-N,N-dimethylaminomethylphenol (0.10% by weight), and glycidyl benzoate with a chlorine content of 0.1% by weight (2.0% by weight) were added to an ester obtained by the reaction of dipentaerythritol with $C_5$ (30% by weight) - $C_6$ (70% by weight) fatty acids at the ratio of 1:6, said ester having a viscosity of 72 $mm^2/s$ at 40° C.), thereby preparing Sample Oil 1.

In addition, trioctyl phosphate (0.5% by weight) and the nitrogenous compound (0.1% by weight), given below, were added to Sample Oil 1 to prepare Sample Oil 2.

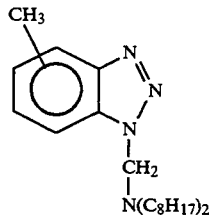

EXAMPLE 2

As in the case of Sample Oil 2, Sample Oil 3 was prepared with the exception that diglycidyl terephthalate was used in place of the glycidyl benzoate.

EXAMPLE 3

As in the case of Sample Oils 1 and 2, Sample Oils 4 and 5 were prepared with the exception that no antioxidants were used at all.

Comparative Example 1

As in the case of Sample Oil 2, Comparative Oil 1 was prepared with the exception that phenyl glycidyl ether was used in lieu of the glycidyl benzoate.

Comparative Example 2

As in the case of Sample Oil 2, Comparative Oil 2 was prepared with the exception that glycidyl 2-ethylhexoate was used in lieu of the glycidyl benzoate.

Comparative Example 3

As in the case of Sample Oil 3, Comparative Oil 3 was prepared with the exception that the nitrogenous compound was not used at all.

Comparative Example 4

As in the case of Sample Oil 3, Comparative Oil 4 was prepared with the exception that benzotriazole was used in place of the nitrogenous compound.

Sample Oils 1–5 and Comparative Oils 1–4 were tested as to their stability to hydrolysis and compatibility with a refrigerant. The results are set out in Table 1.

TABLE 1

| | Stability | | Compatibility with Refrigerant | |
|---|---|---|---|---|
| | T.A.N. | Precipitation | L.T. | H.T. |
| S.O. 1 | 0.07 | not found | −40° C. or below | 80° C. or more |
| 2 | 0.07 | — | — | — |
| 3 | 0.04 | — | — | — |
| 4 | 0.07 | — | — | — |
| 5 | 0.07 | — | — | — |
| C.O. 1 | 0.30 | — | — | — |
| 2 | 0.30 | — | clouding found at room temperature | |
| 3 | 0.04 | found | −40° C. or below | 80° C. or more |
| 4 | 0.04 | found | — | — |

T.A.N.: Total Acid Number in mg KOH/g
L.T.: Low Temperature in °C.
H.T.: High Temperature in °C.
S.O.: Sample Oil
C.O.: Comparative Oil As can be seen from Table 1, the lubricating oil compositions of the invention are excellent in stability to hydrolysis and well compatible with the R134a refrigerant, and so provide excellent refrigerating machine oil compositions.

EXAMPLE 4

Glycidyl benzoate with a chlorine content of 0.1% by weight (2.0% by weight) was added to polypropylene glycol dimethyl ether (having a viscosity of 40 $mm^2/s$ at 40° C. and a hydroxyl number of 5 mg KOH/g) to prepare Sample Oil 6. It is noted, however, that the hydroxyl numbers of polyethers referred to in the following examples are measured according to JIS K-1525.

EXAMPLE 5

As in the case of Sample Oil 6, Sample Oil 7 was prepared with the exception that the same amount of 3,4-epoxycyclohexylmethyl-3,4-epoxycyclohexane carboxylate with a chlorine content of 0.3% by weight was used in place of the glycidyl benzoate.

EXAMPLE 6

Following the procedure of preparing Sample Oil 6 in Example 4, glycidyl benzoate with a chlorine content of 0.1% by weight (5.0% by weight) was added to polypropylene glycol dimethyl ether having a hydroxyl number of 15 mg KOH/s, thereby preparing Sample Oil 8.

EXAMPLE 7

Sample Oil 9 was prepared by adding 2.0% by weight of glycidyl benzoate with a chlorine content of 0.1% by weight to polypropylene glycol dibutyl ether having a viscosity of 20 $mm^2/s$ at 40° C. and a hydroxyl number of 5 mg KOH/s.

EXAMPLE 8

Sample Oil 10 was prepared by adding to Sample Oil 6 trioctyl phosphate (0.5% by weight) and the nitrogenous compound (0.1% by weight), given below.

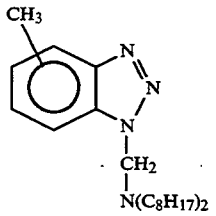

Comparative Example 5

Comparative Oil 5 was prepared by adding 2.0% by weight of 3,4-epoxycyclohexylmethyl-3,4-epoxycyclohexane carboxylate with a chlorine content of 0.3% by weight to polypropylene glycol dimethyl ether having a viscosity of 40 $mm^2/s$ at 40° C. and a hydroxyl number of 15 mg KOH/s.

Comparative Example 6

As in the case of Comparative Oil 5, Comparative oil 6 was prepared with the exception that 3,4-epoxycyclohexylmethyl-3,4-epoxycyclohexane carboxylate having a chlorine content of 0.6% by weight, not 0.3% by weight, was used in the same amount.

Comparative Example 7

As in the case of Sample Oil 6, Comparative Oil 7 was prepared with the exception that the amount of the glycidyl benzoate was changed to 25% by weight.

Comparative Example 8

As in the case of Sample Oil 6, Comparative Oil 8 was prepared with the exception that 2.0% by weight of phenyl glycidyl ether was used in place of the glycidyl benzoate.

Sample Oils 6–10 and Comparative Oils 5–8 were tested as to their stability to oxidation and compatibility. The results are set out in Table 2.

TABLE 2

| | Stability to Oxidation | | Compatibility with Refrigerant | |
|---|---|---|---|---|
| | T.A.N. | Precipitation | L.T. | H.T. |
| S.O. 6 | 0.07 | not found | −40° C. or below | 75° C. |
| 7 | 0.07 | — | — | — |
| 8 | 0.10 | — | — | — |
| 9 | 0.07 | — | — | — |
| 10 | 0.07 | — | — | — |
| C.O. 5 | 0.25 | — | 0° C. | 75° C. |
| 6 | 0.25 | found | — | — |
| 7 | 0.10 | not found | — | — |
| 8 | 0.30 | not found | −40° C. or below | 75° C. |

T.A.N.: Total Acid Number in mg KOH/g
L.T.: Low Temperature in °C.
H.T.: High Temperature in °C.
S.O.: Sample Oil
C.O.: Comparative Oil As can be seen from Table 2, the lubricating oil compositions of the invention are excellent in stability to hydrolysis and well compatible with the non-chlorine type of fluorine-containing refrigerant, and so provide excellent refrigerating machine oil compositions.

EXAMPLE 9

Antioxidants di(octylphenyl)amine (0.20% by weight) and 2,6-di-t-butyl-4-N,N-dimethylaminomethylphenol (0.10% by weight), and glycidyl o,o-dibutylphosphono-2-methylpropionate (2.0% by weight), given below, were added to an ester obtained by the reaction of dipentaerythritol with 2-methylhexoic acid at the molar ratio of 1:6, said ester having a viscosity of 72 $mm^2/s$ at 40° C., thereby preparing Sample Oil 11.

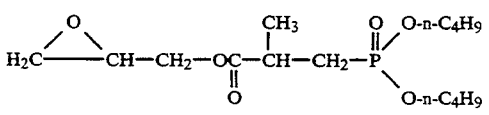

EXAMPLE 10

As in the case of Sample Oil 11, Sample Oil 11 was prepared with the exception that 2% by weight of dioctyl hydroxymethylphosphonate was used in place of the glycidyl o,o-dibutylphosphono-2-methylpropionate.

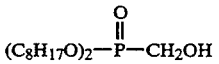

EXAMPLE 11

As in the case of Sample Oil 11, Sample Oil 13 was prepared with the exception that 2% by weight of ethyl 3-diethylphosphonopropionate, given below, was used in place of the glycidyl o,o-dibutylphosphono-2-methylpropionate.

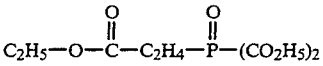

EXAMPLE 12

As in the case of Sample Oil 11, Sample Oil 14 was prepared with the exception that 2% by weight diethyl phenylphosphonate, given below, was used in place of the glycidyl o,o-dibutylphosphono-2-methylpropionate.

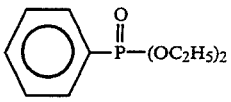

EXAMPLE 13

As in the case of Sample Oil 11, Sample Oil 15 was prepared with the exception that 2% by weight of diethyl 3,5-di-t-butyl-4-hydroxybenzylphosphonate, given below, was used in place of the glycidyl o,o-dibutylphosphono-2-methylpropionate.

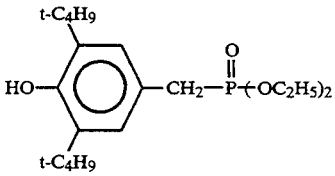

EXAMPLE 14

As in the case of Sample Oil 11, Sample Oil 16 was prepared with the exception that no antioxidant was used at all.

EXAMPLE 15

Sample Oil 17 was prepared by adding 2% by weight of glycidyl o,o-dibutylphosphono-2-methylpropionate to polypropylene glycol dimethyl ether (having a viscosity of 40 $mm^2/s$ at 40° C. and a hydroxyl number of 5 mg KOH/g.

EXAMPLE 16

Sample Oil 18 was prepared by adding antioxidants di(octylphenyl)amine (0.20% by weight) and 2,6-di-t-butyl-4-N,N,-dimethylaminomethylphenol (0.10% by weight) to Sample Oil 17.

EXAMPLE 17

Glycidyl benzoate with a chlorine content of 0.1% by weight (2.0% by weight) and ethyl 3-diethylphosphonopropionate (2% by weight) were added to an ester obtained by the reaction of dipentaerythritol with $C_5$ (30% by weight) - $C_6$ (70% by weight) fatty acids at the ratio of 1:6, said ester having a viscosity of 72 $mm^2/s$ at 40° C.), thereby preparing Sample Oil 19.

In addition, 0.1% by weight of the nitrogenous compound, given below, was added to Sample Oil 19 to prepare Sample Oil 20.

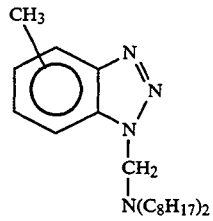

EXAMPLE 18

Sample Oil 21 was prepared by adding 2.0% by weight of glycidyl benzoate with a chlorine content of 0.1% by weight and 2% by weight of ethyl 3-diethylphosphonopropionate to polypropylene glycol dimethyl ether having a viscosity of 40 $mm^2/s$ at 40° C. and a hydroxyl number of 5 mg KOH/g.

In addition, 0.1% by weight of the nitrogenous compound, given below, was added to Sample Oil 21 to prepare Sample Oil 22.

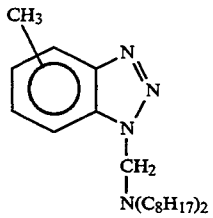

Comparative Example 9

As in the case of Sample Oil 11, Comparative Oil 9 was prepared with the exception that 2% by weight of tricresyl phosphate was used in place of the glycidyl o,o-dibutylphosphono-2-methylpropionate.

Comparative Example 10

As in the case of Sample Oil 11, Comparative Example 10 was prepared with the exception that 2% by weight of tri-1,3dichloropropylphosphate, given below, was used in the place of the glycidyl o,o-dibutylphosphono-2-methylpropionate.

$$O{=}P{-}(OCHClCH_2CH_2Cl)_3$$

Comparative Example 11

Comparative Oil 11 was Sample Oil 11 free from glycidyl o,o-dibutylphosphono-2-methylpropionate.

Sample Oils 11–22 and Comparative Oils 9–11 were subjected to abrasion testing. The results are set out in Table 3.

TABLE 3

| | Al Abrasion Loss ($\times 10^{-3}$ $mm^3$) | | Fe Abrasion Dent Diameter (mm) | |
|---|---|---|---|---|
| | in the air | in R134a | in the air | in R134a |
| S.O. 11 | 1.2 | 0.8 | 17 | 16 |
| 12 | 1.0 | 0.6 | 15 | 14 |
| 13 | 1.4 | 1.2 | 18 | 16 |
| 14 | 1.0 | 0.6 | 15 | 14 |
| 15 | 1.2 | 0.8 | 17 | 16 |
| 16 | 1.2 | 0.8 | 17 | 16 |
| 17 | 1.1 | 0.7 | 16 | 16 |
| 18 | 1.1 | 0.7 | 16 | 16 |
| 19 | 1.0 | 0.6 | 15 | 13 |
| 20 | 1.0 | 0.6 | 15 | 13 |

TABLE 3-continued

| | Al Abrasion Loss ($\times 10^{-3}$ $mm^3$) | | Fe Abrasion Dent Diameter (mm) | |
|---|---|---|---|---|
| | in the air | in R134a | in the air | in R134a |
| 21 | 0.8 | 0.6 | 15 | 13 |
| 22 | 0.8 | 0.6 | 15 | 13 |
| C.O. 9 | 0.6 | 2.3 | 15 | 21 |
| 10 | 1.5 | 3.1 | 17 | 21 |
| 11 | 2.1 | 2.3 | 20 | 21 |

S.O.: Sample Oil
C.O.: Comparative Oil

As can be seen from Table 3, the lubricating oil compositions of the invention exhibit excellent lubricating properties in the oxygen-free atmosphere, and so provide excellent refrigerating machine oil, for instance.

Then, the capability of Sample Oils 11, 13 and 15–22 to be used as refrigerating oil was estimated by compatibility, stability-to-hydrolysis and sealed tube testings. It is noted that the compatibility testing was carried out as follows.

Compatibility Testing Procedure

A sample oil (3% by weight) and a refrigerant—1.1.1.2-tetrafluoroethane (10% by weight) are mixed together in a glass tube at a total amount of 2 ml. The glass tube is then placed in a constant temperature bath having a heater and a cooler to measure the temperature at which the sample oil separates from the refrigerant.

The results are set out in Tables 4 and 5.

TABLE 4

| | Sample Oil | | | | |
|---|---|---|---|---|---|
| | Sample Oil 11 | Sample Oil 13 | Sample Oil 15 | Sample Oil 16 | Sample Oil 17 |
| Compatability with Refrigerant | 90° C. or More | 90° C. or More | 90° C. or More | 90° C. or More | 75° C. |
| High-Temperature Phase Separation Temperature; Oil Fraction 10 wt % | | | | | |
| Low-Temperature Phase Separation Temperature; Oil Fraction 10 wt % | −40° C. | −40° C. | −40° C. | −40° C. | −40° C. |
| Stability to Hyrolysis[1] after Testing | 0.05 | 0.05 | 0.05 | 0.08 | 0.08 |
| Sealed Tube Testing Color (ASTM) | 1.0 | 1.0 | 1.0 | 1.0 | 1.0 |
| Catalyst Appearance | Good | Good | Good | Good | Good |

[1]Total Acid Number mg KOH/g

TABLE 5

| | Sample Oil | | | | |
|---|---|---|---|---|---|
| | Sample Oil 18 | Sample Oil 19 | Sample Oil 20 | Sample Oil 21 | Sample Oil 22 |
| Compatability with Refrigerant | 75° C. | 80° C. or More | 80° C. or More | 75° C. | 75° C. |
| High-Temperature Phase Separation Temperature; Oil Fraction 10 wt % | | | | | |
| Low-Temperature Phase Separation Temperature; Oil Fraction 10 wt % | −40° C. | −40° C. or Less | −40° C. or Less | −40° C. or Less | −40° C. or Less |
| Stability to Hyrolysis[1] after Testing | 0.07 | 0.07 | 0.07 | 0.07 | 0.07 |
| Sealed Tube Testing Color (ASTM) | 1.0 | 1.0 | 1.0 | 1.0 | 1.0 |
| Catalyst Appearance | Good | Good | Good | Good | Good |

[1]Total Acid Number mg KOH/g

As can be appreciated from Tables 4 and 5, the lubricating oil compositions of the invention are excellent in compatibility with the refrigerant, stability to hydrolysis and chemical and thermal stability at elevated temperatures and low temperatures as well, and provide particularly excellent refrigerating machine oil that is used with a refrigerant R134a.

What we claim is:

1. A lubricating oil composition comprising a lubricating oil base containing 0.1 to 20% by weight of an aromatic glycidyl carboxylate of the formula

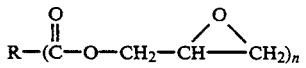

wherein R is an aryl or alkylaryl group having 6 to 14 carbon atoms and n is 1 or 2.

2. A lubricating oil composition according to claim 1 further comprising 0.05 to 10% by weight of a phosphonate additive of the formula

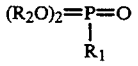

wherein $R_1$ and $R_2$ may be substituted and are each selected from the group consisting of alkyl, aralkyl, aryl and hydroxyalkyl groups.

3. A lubricating oil composition according to claim 2 further comprising 0.01 to 5% by weight of a benzotriazole compound of the formula

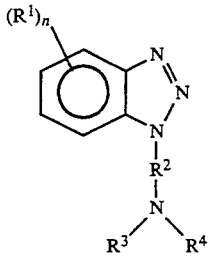

where $R^1$ is an alkyl or aryl group having 1 to 6 carbon atoms, $R^2$ is an alkylene or arylene group having 1 to 6 carbon atoms, $R^3$ and $R^4$ are each an alkyl, aryl or alkylaryl group having 1 to 12 carbon atoms, or $R^3$ and $R^4$ taken together form a heterocycle, and n is 0 or 1.

4. A lubricating oil composition as claimed in claim 1, 2 or 3, which is a refrigerating machine oil wherein the lubricating oil base is an ester oil having a viscosity in the range of 10 to 500 $mm^2/s$ at 40° C.

5. A lubricating oil composition as claimed in claim 1, 2 or 3, which is a refrigerating machine oil wherein the lubricating oil base is a polyether oil having a viscosity in the range of 10 to 500 $mm^2/s$ at 40° C.

* * * * *